United States Patent [19]

Voltz

[11] Patent Number: 4,914,062

[45] Date of Patent: Apr. 3, 1990

[54] SHIELDED RIGHT ANGLED HEADER

[75] Inventor: John Voltz, Newark, Del.

[73] Assignee: W. L. Gore & Associates, Inc., Newark, Del.

[21] Appl. No.: 311,664

[22] Filed: Feb. 15, 1989

[51] Int. Cl.[4] ..... H01R 13/648

[52] U.S. Cl. ..... 439/608; 439/101

[58] Field of Search ..... 439/607, 608, 609, 610, 439/98, 92, 101, 108, 577, 581, 582, 63

[56] References Cited

U.S. PATENT DOCUMENTS

| | | | |
|---|---|---|---|
| 4,360,244 | 11/1982 | Forney, Jr. et al. | 439/581 |
| 4,639,053 | 1/1987 | Reichardt et al. | 439/98 |
| 4,707,040 | 11/1987 | Hansel, III | 439/98 X |
| 4,708,666 | 11/1987 | Fisher, Jr. | 439/580 |
| 4,741,703 | 5/1988 | Johnescu et al. | 439/63 |
| 4,773,878 | 9/1988 | Hansell, III | 439/497 |

FOREIGN PATENT DOCUMENTS

| | | | |
|---|---|---|---|
| 2027290 | 2/1980 | United Kingdom | 439/608 |

OTHER PUBLICATIONS

AMP Fifteenth Annual Connectors and Interconnection Technology Symposium Proceedings, Nov. 2, 1982, p. 359, FIG. 7.

*Primary Examiner*—Neil Abrams
*Assistant Examiner*—Khiem Nguyen

[57] ABSTRACT

A right-angled header for attaching a multiplicity of coaxial electric cables, either separately of together in a flat cable, to a printed circuit board, the signal circuit of the header being internally shielded from interfering outside signals and from each other within the body of the header.

4 Claims, 2 Drawing Sheets

SHIELDED RIGHT ANGLED HEADER

FIELD OF THE INVENTION

This invention relates to the field of headers having a plurality of signal posts and ground posts for connecting coaxial electrical cables to printed circuit boards (PCB).

BACKGROUND OF THE INVENTION

In many commercial and testing applications, it is desirable to feed a coaxial signal line through to printed circuit board circuitry. High quality circuit interconnections, cable to PCB, have been difficult to achieve because of the combination of stringent electrical signal performance requirements with relatively limited space constraints. Such a connector or header must be miniature in scale, but must meet stringent performance requirements resulting from high speed or high frequency data transmission.

Presently, most coaxial cable connectors or headers designed for attaching a miniature cable to a PCB are assembled from many parts, which, owing to their size and complexity, may be difficult to make, complicated to assemble, or expensive, particularly for right-angled headers. Typical of right-angled headers for attaching a single coaxial cable to a PCB is that disclosed in U.S. Pat. No. 4,360,244, wherein the header comprises two mateable right-angled units, one of which is a right-angled metal shell containing therein insulation with a right-angled pin centered within the insulation and the signal contact pin projecting from the surface to be attached to the PCB along with a grounding contact pin affixed to or in contact with the metal shell. A similar right-angled shielded coaxial contact, mateable with the above right-angled unit, is attached to the coaxial electrical cable desired to be attached thereby to the PCB. A somewhat similar triaxial right-angled header for attaching a triaxial cable directly to a PCB is described by U.S. Pat. No. 4,741,703.

A connector for shielded flat coaxial cable made up from a multiplicity of coaxial cables is disclosed in U.S. Pat. No. 4,639,053, wherein a connector housing has arranged within it an insulating body, a grounding sheet metal spring for contacting the shields of the individual cables comprising the flat cable, and grounding metal layers along interior walls of the housing to form direct contact with the shield surrounding the flat cable as a whole.

SUMMARY OF THE INVENTION

The present invention comprises a shielded right-angled header having a multiplicity of signal connecting posts and a multiplicity of ground connecting posts in evenly ordered arrangement. Each signal post is incorporated in thermoplastic insulation and covered by a shielding metallic shell. Each metallic shell is attached to a ground post. These units of an associated shielded insulated signal post and a ground post are held together by a plastic shroud to form the complete header. Thus, in a header formed from as many pairs of signal and ground posts as are needed each signal conductor is individually shielded completely in metal shielding for reduction of crosstalk between signals which are transmitted through closely spaced conductors of very small size within very stringent space requirements. This arrangement allows higher signal transmission performance than before, performance suitable for computers, automatic test equipment, and telecommunication equipment signals. The materials of manufacture and the spacing and configuration of the parts of the headers may be modified to allow impedance matching, and to allow for adjustments in spacing and mounting characteristics.

DESCRIPTION OF THE PREFERRED EMBODIMENTS

Figure 1:
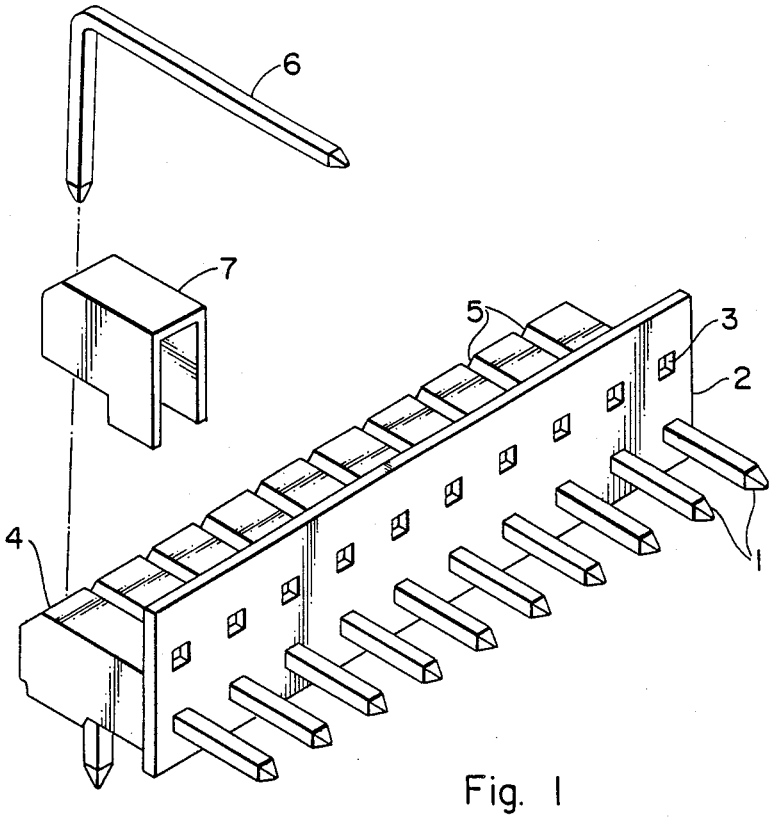
FIG. 1 is a fragmentary perspective view of the header showing the signal contacts molded into insulation with metal shield and ground contact pin posts also shown.

Referring now to the figures to more fully and completely describe the invention, FIG. 1 shows a fragmentary perspective view of parts of the header. A row of right-angled signal contact pins 1 is molded into or imbedded in thermoplastic insulation with pins 1 protruding through face 2. Surrounding each individual pin 1 is insulation 4, leaving a gap 5 between each insulated pin to allow a metallic shielding shell 7 to be fitted around each part 4 in gap 5. Right-angled ground contact pins 6 are fitted through apertures 3 in face 2 and attached to shell 7.

Figure 2:
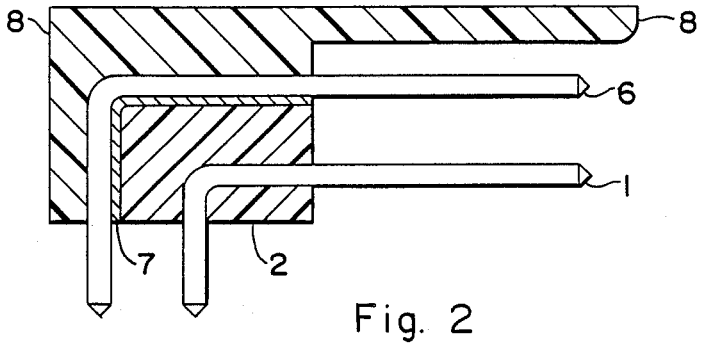
FIG. 2 shows a cross-section of the header along a plane parallel to a pair of signal and ground contact pins.

FIG. 2 describes a cross-section of the header along a plane parallel to a pair of ground 6 and signal contact 1 pins after a thermoplastic insulative shroud 8 has been molded onto the assemblage of parts shown in FIG. 1.

Figure 3:
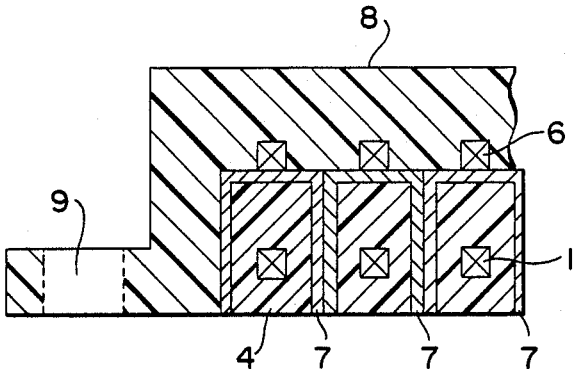
FIG. 3 describes a cross-section of the header in a plane perpendicular to the signal and ground contact pins.

FIG. 3 is a partial cross-section of the header perpendicular to the contact pins 1 and 6, through the metallic shielding shells 7, molded thermoplastic post 4, and thermoplastic shroud 8. An optional mounting aperture 9 through an end of shroud 8 is shown.

The header is assembled by molding signal contact pins 1 into thermoplastic polyester polymer, a preferred material. Also usable are other thermoplastics known in the art to be useful for injection or other kinds of molding, such as polyphenylene sulfide, polyamide, acetal, acetylene-butadiene-styrene terpolymer, polytetrafluoroethylene, polyvinyl chloride, polypropylene, polyethylene, or rubber. The shielding metal shells 7 are now attached to ground contact pins 6 by welding, brazing, soldering, or by a conductive adhesive. The shells 7 are made preferably from thin folded sheets of beryllium-copper alloy or phosphor bronze, but copper or copper alloys or steel shells may also be used. The pins 1 and 6 are also manufactured preferably from beryllium-copper alloy or phosphor bronze. The ground contact pins 6 may also be an integral part of the metal sheet from which shell 7 is made, small flat tabs or protrusions of which can be rolled up into cylindrical or square forms to serve as pins 6. The combined shells 7 and pins 6, either affixed to each other or formed as a unit from a metal sheet, are fitted into apertures 3 and slots 5 and the combination molded into a thermoplastic shroud 8 to complete the header. The shroud 8 can be pre-molded and attached to the pins, shield, and contacts by sonic welding which bonds plastic to plastic without heating the bulk of the material. Shroud 8 is preferably molded from glass-filled thermoplastic polyester polymer and can also be molded from the same materials as molded part 4.

In many commercial and test applications it is desirable to feed coaxial signal lines through to a printed circuit board. The header of this invention accomplishes this feed in a simple direct manner without complicated parts or attachments. In operation, the contact pins 1 and 6 projecting from face 2 of the header are terminated to female connectors which in turn are connected to coaxial cables or flat coaxial cables. The opposite ends of pins 1 and 6 of the header are connected beneath shroud 8 to mating receptacles or apertures in an printed circuit board which are spaced in a standard prearranged pattern to mate with pins 1 and 6.

While the foregoing describes the preferred embodiments of the invention, other embodiments which utilize the teachings herein set forth which will be apparent to one skilled in the art, are intended to be within the scope of the invention, the bounds of which are set forth in the appended claims.

I claim:

1. A right-angled header for connecting a coaxial electrical cable to a printed circuit board comprising:

(a) a molded thermoplastic encapsulating insulative body surrounding and holding in evenly ordered arrangement;

(b) one or more right-angled conductive metal electrical signal contact pins;

(c) each of which pins is surrounded by said insulative body and a separate conductive metal shell;

(d) associated with each signal contact pin a right-angled metal ground contact pin which is affixed to each conductive metal shell; and (e) a molded thermoplastic shroud surrounding all faces of said header which do not have contact pins extending from their surface and bonding said header into an unitary whole.

2. A header of claim 1 wherein the thermoplastic encapsulating the signal contact pins and forming the shroud comprises polyester, polyvinyl chloride, polyphenylene sulfide, polyamide, acetal, acetylene-butadiene-styrene terpolymer, polytetrafluoroethylene, polypropylene, polyethylene, or rubber.

3. A header of claim 1 wherein said ground and signal contact pins and said conductive metal shells are formed from beryllium-copper, phosphor bronze, steel, copper, or copper alloys.

4. A header of claim 1 wherein the thermoplastic encapsulating the signal contact pins and forming the shroud comprises polyester and the ground and signal contact pins and the conductive shell comprise beryllium-copper alloy or phosphor bronze.

* * * * *